United States Patent [19]

Sullivan

[11] Patent Number: 4,753,619

[45] Date of Patent: Jun. 28, 1988

[54] MARINE PROPULSION DEVICE BELLOWS ASSEMBLY

[76] Inventor: Donald K. Sullivan, 26 N. Park, Waukegan, Ill. 60085

[21] Appl. No.: 901,967

[22] Filed: Aug. 29, 1986

Related U.S. Application Data

[63] Continuation of Ser. No. 722,003, Apr. 11, 1985, abandoned.

[51] Int. Cl.[4] ..... B63H 21/32

[52] U.S. Cl. ..... 440/88; 277/212 FB; 440/112

[58] Field of Search ..... 277/212 FB, 30, 207; 285/226–228, 2; 440/112, 88, 89, 76, 78, 110

[56] References Cited

U.S. PATENT DOCUMENTS

| | | | |
|---|---|---|---|
| 3,429,599 | 2/1969 | Schmidt | 277/212 FB |
| 3,506,289 | 4/1970 | Gottschald | 277/212 FB |
| 3,865,068 | 2/1975 | Haasl | 440/112 |
| 3,888,203 | 6/1975 | Lohse | 440/53 |
| 3,997,192 | 12/1976 | Hansen | 285/226 |
| 4,178,873 | 12/1979 | Bankstahl | 440/89 |
| 4,201,391 | 5/1980 | Bankstahl | 277/30 |
| 4,289,488 | 9/1981 | Weronke | 440/57 |
| 4,371,348 | 2/1983 | Blanchard | 440/52 |

FOREIGN PATENT DOCUMENTS

| | | | |
|---|---|---|---|
| 2300821 | 7/1974 | Fed. Rep. of Germany | 440/42 |
| 826440 | 1/1960 | United Kingdom | 277/212 FB |

*Primary Examiner*—Joseph F. Peters, Jr.
*Assistant Examiner*—Edwin L. Swinehart

[57] ABSTRACT

A marine propulsion device comprising a pivot housing adapted to be mounted on the transom of a boat for pivotal movement relative to the transom about a generally vertical steering axis, and about a generally horizontal tilt axis, the pivot housing including a rear end and an opening, a propulsion unit removably connected to the rear end of the pivot housing for pivotal movement with the pivot housing, a flexible bellows having an end communicating with the opening in the pivot housing, and a removable spring clamp for securing the end of the bellows to the pivot housing, the spring clamp functioning independently of the connection of the propulsion unit to the pivot housing and being removable from the rear end of the pivot housing when the propulsion unit is disconnected from the pivot housing.

1 Claim, 1 Drawing Sheet

MARINE PROPULSION DEVICE BELLOWS ASSEMBLY

This application is a continuation of U.S. Ser. No. 722,003, filed Apr. 11, 1985, now abandoned.

BACKGROUND OF THE INVENTION

The invention relates to bellows assemblies for marine propulsion devices, and, more particularly, to means for attaching a bellows to the pivot housing of a marine propulsion device.

In a typical stern drive or inboard/outboard marine propulsion device, exhaust gases pass from the gimbal housing to the pivot housing through a flexible bellows extending between the gimbal housing and the pivot housing.

One means for attaching a bellows to the pivot housing is disclosed in U.S. Bland patent application titled "Marine Propulsion Device Bellows Assembly," U.S. Ser. No. 722,004, filed Apr. 11, 1985, assigned to the assignee of the present application.

One prior means of attaching a bellows to the gimbal housing and to the pivot housing is with band clamps.

Another prior means for attaching a bellows to the pivot housing is disclosed in Bankstahl U.S. Pat. No. 4,201,391, issued May 6, 1980.

Attention is also directed to the following U.S. patents which disclose marine propulsion device bellows or exhaust assemblies:

Lohse: U.S. Pat. No. 3,888,302, issued June 10, 1975;
Bankstahl: U.S. Pat. No. 4,178,873, issued Dec. 18, 1979;
Weronke: U.S. Pat. No. 4,289,488, issued Sept. 15, 1981;
Blanchard: U.S. Pat. No. 4,371,348, issued Feb. 1, 1983

SUMMARY OF THE INVENTION

The invention provides a marine propulsion device comprising a pivot housing adapted to be mounted on the transom of a boat for pivotal movement relative to the transom about a generally vertical steering axis, and about a generally horizontal tilt axis, the pivot housing including a rear end and an opening, a propulsion unit removably connected to the rear end of the pivot housing for pivotal movement with the pivot housing, a flexible bellows having an end communicating with the opening in the pivot housing, and removable means for securing the end of the bellows to the pivot housing, the removable means functioning independently of the connection of the propulsion unit to the pivot housing and being removable from the rear end of the pivot housing when the propulsion unit is disconnected the said pivot housing.

In one embodiment, the removable means includes means positioned inside the end of the bellows for connecting the end of the bellows to the pivot housing.

In one embodiment, the end of the bellows extends inside the opening in the pivot housing, and the connecting means includes biasing means positioned inside the end of the bellows for biasing the bellows outwardly against the pivot housing.

In one embodiment, the biasing means includes a spring clamp.

In one embodiment, the bellows has an inside surface having therein an annular groove adjacent the end of the bellows, and the spring clamp is received in the groove.

In one embodiment, the pivot housing includes a lip extending inwardly around the opening, and the end of the bellows includes an outwardly extending flange engaged with the lip.

In one embodiment, the lip has a radially inner surface and a rearward surface, and the flange engages the rearward surface and the groove is located rearwardly of the rearward surface and extends outwardly of the radially inner surface of the lip into the flange.

The invention also provides a marine propulsion device comprising a pivot housing adapted to be mounted on the transom of a boat for pivotal movement relative to the transom, the pivot housing including an opening, a flexible conduit having an end communicating with the opening in the pivot housing, and means positioned inside the end of the conduit for connecting the end of the conduit to the pivot housing.

The invention also provides a marine propulsion device comprising a pivot housing adapted to be mounted on the transom of a boat for pivotal movement relative to the transom about a generally vertical steering axis, and about a generally horizontal tilt axis, the pivot housing including an opening, a propulsion unit removably connected to the pivot housing for pivotal movement with the pivot housing, a flexible bellows having an end extending inside the opening in the pivot housing and communicating with the opening in the pivot housing, and biasing means positioned inside the end of the bellows for biasing the bellows outwardly against the pivot housing to secure the end of the bellows to the pivot housing.

The invention also provides a marine propulsion device comprising a pivot housing adapted to be mounted on the transom of a boat for pivotal movement relative to the transom about a generally vertical steering axis, and about a generally horizontal tilt axis, the pivot housing including a rear end, an opening, and a lip extending inwardly around the opening, the lip having a radially inner surface and a rearward surface, a propulsion unit removably connected to the rear end of the pivot housing for pivotal movement with the pivot housing, a flexible bellows having an end extending inside the opening in the pivot housing and communicating with the opening in the pivot housing, the end of the bellows including an outwardly extending flange engaged with the rearward surface of the lip on the pivot housing, and the bellows also having an inside surface having therein an annular groove adjacent the end of the bellows, the groove being located rearwardly of the rearward surface of the lip and extending outwardly of the radially inner surface of the lip into the flange, and removable means for securing the end of the bellows to the pivot housing, the removable means functioning independently of the connection of the propulsion unit to the pivot housing and being removable from the rear end of the pivot housing when the propulsion unit is disconnected from the pivot housing, the removable means including a spring clamp received in the groove for biasing the bellows outwardly against the pivot housing to secure the end of the bellows to the pivot housing.

A principal feature of the invention is the provision of removable means for securing the end of the bellows to the pivot housing, the removable means functioning independently of the connection of the propulsion unit to the pivot housing and being removable from the rear end of the pivot housing when the propulsion unit is disconnected from the pivot housing.

Another principal feature of the invention is the provision of means positioned inside the end of the bellows for connecting the end of the bellows to the pivot housing.

Another principal feature of the invention is the provision of a bellows having an end extending inside an opening in the pivot housing and biasing means positioned inside the end of the bellows for biasing the bellows outwardly against the pivot housing.

Other features and advantages of the invention will become apparent to those skilled in the art upon review of the following detailed description, claims, and drawings.

Figure 1:
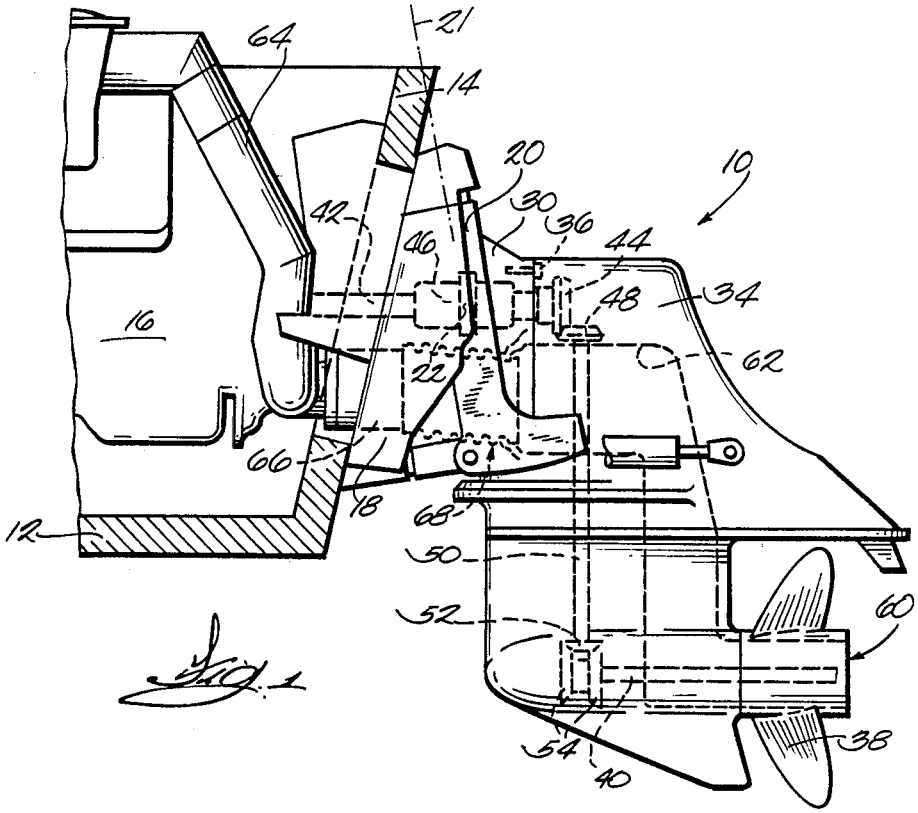
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a marine propulsion device 10 mounted on a boat 12 having a transom 14. The marine propulsion device 10 is of the stern drive or inboard/outboard type.

As best shown in FIG. 1, the marine propulsion device 10 comprises an engine 16 securely mounted on the boat frame by suitable means such as rubber mounts (not shown). The marine propulsion device 10 also comprises a gimbal housing 18 mounted on the outer surface of the boat transom 14 and fixedly attached to the boat transom 14. The gimbal housing 18 can be attached to the boat transom 14 by any suitable means, such as bolts extending through the transom 14.

The marine propulsion device 10 also comprises a gimbal ring 20 connected to the gimbal housing 18 for pivotal movement relative to the gimbal housing 18 about a generally vertical steering axis 21, and a pivot housing 30 connected to the gimbal ring 20 for pivotal movement relative to the gimbal ring 20 about a generally horizontal tilt axis 22. Such a construction is well known in the art and need not be described in greater detail.

The marine propulsion device 10 also comprises a propulsion unit 34 removably connected to the pivot housing 30 for common pivotal movement of the propulsion unit 34 with the pivot housing 30. In the illustrated construction, the propulsion unit 34 is removably connected to the pivot housing 30 by a plurality of bolts 36. The propulsion unit 34 includes a propeller 38 mounted on a propeller shaft 40, and a generally horizontal drive shaft 42 having one end removably connected to the engine 16 and an opposite end having thereon a bevel gear 44. A universal joint 46 attached to the horizontal drive shaft 42 allows pivotal movement of the drive shaft 42 with the propulsion unit 34. The bevel gear 44 drives a bevel gear 48 on the upper end of a vertical drive shaft 50. The lower end of the vertical drive shaft 50 has thereon a driving gear 52. A reversible transmission selectively clutches a pair of driven gears 54 to the propeller shaft 40 to transmit forward or reverse motion to the propeller shaft 40 from the driving gear 52.

The marine propulsion device 10 further comprises an exhaust outlet 60, and an exhaust passageway 62 communicating between the engine 16 and the exhaust outlet 60 and conducting exhaust gases away from the engine 16. In the illustrated construction, the exhaust outlet 60 is located at the lower end of the propulsion unit 34 so that the exhaust gases are discharged underwater. It is well known in the art to discharge exhaust gases underwater in order to reduce noise.

In the preferred embodiment, the exhaust passageway 62 extends from the engine 16 to the gimbal housing 18, through the gimbal housing 18, from the gimbal housing 18 to the pivot housing 30, through the pivot housing 30 to the propulsion unit 34, and through the propulsion unit 34 to the exhaust outlet 60. The portion of the exhaust passageway 62 extending through the propulsion unit 34 is conventional and need not be described in greater detail.

In the preferred embodiment, the portion of the exhaust passageway 62 extending between the engine 16 and the gimbal housing 18 includes a pair of exhaust pipes 64 (only one is shown in FIG. 1) communicating with the engine 16 and converging into the gimbal housing 18.

Figure 2:
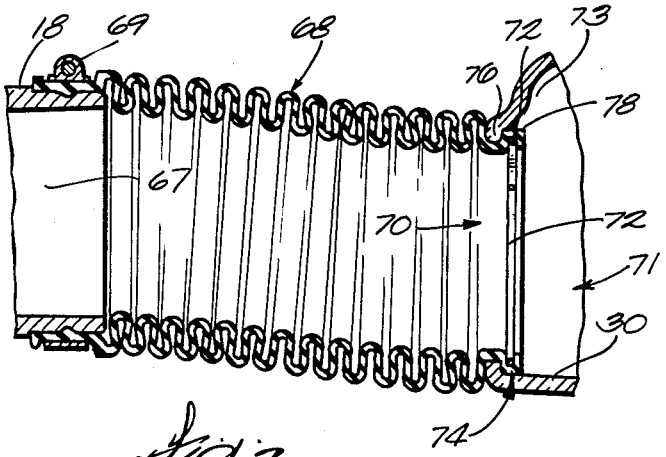
FIG. 2 is an enlarged cross-sectional view of the pivot housing showing the connection of the bellows to the pivot housing.

The portion of the exhaust passageway 62 extending through the gimbal housing 18 is a generally horizontal conduit 66. The forward end of the conduit 66 communicates with the exhaust pipes 64, and the rearward end of the conduit 66 is formed by a rearwardly projecting portion 67 (see FIG. 2) of the gimbal housing 18.

The portion of the exhaust passageway 62 extending from the gimbal housing 18 to the pivot housing 30 includes a flexible exhaust bellows, duct, or conduit 68. The forward end of the bellows 68 is secured to the projecting portion 67 of the gimbal housing 18 by a conventional band clamp 69 (see FIG. 2). At its rearward end, the bellows 68 includes an outwardly extending flange 78 having a forwardly facing surface and an inside surface having therein an annular groove 74 extending radially outwardly into the flange 78 and including a radially outer part.

The pivot housing 30 includes (see FIG. 2) an exhaust gas passageway 72 which communicates with the exhaust passageway portion in the propulsion unit 34, and with the rearward end of the bellows 68.

More particularly, the passageway 71 in the pivot housing 30 includes a first passageway portion 73 which is defined by a first interior surface portion and which includes a circumference, and which receives the flange 78, together with an opening 70 which is smaller than the first passageway portion 73, which is located immediately forwardly of the first passageway portion 73 and communicates therewith, and which is defined by a lip 76 extending forwardly from the first interior surface portion and radially inwardly from throughout the circumference of the first passageway portion 73 and beyond the radially outer part of said groove 74. The lip 76 has a rearward surface in engagement with the forwardly facing surface of the flange 78. The passageway 71 also includes a second passageway portion 75 which is at least as large as the first passageway portion 73, which is located immediately rearwardly of the first passageway portion 73 and communicates therewith, and which is defined by an interior surface portion located immediately rearwardly of the first interior surface portion.

The marine propulsion device 10 further comprises removable means for securing the rearward end of the bellows 68 to the pivot housing 30, the removable means functioning independently of the connection of the propulsion unit 34 to the pivot housing 30 and being removable from the rear end of the pivot housing 30 when the propulsion unit 34 is disconnected from the pivot housing 30. In other words, the removable means secures the end of the bellows 68 to the pivot housing 30 both when the propulsion unit 34 is connected to the pivot housing 30, and when the propulsion unit 34 is disconnected from the pivot housing 30.

Figure 3:
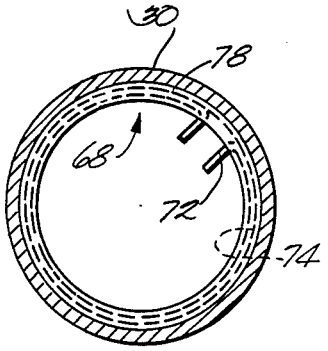
FIG. 3 is an end view of the pivot housing with the propulsion unit disconnected from the pivot housing.

While various suitable removable means can be employed, in the illustrated construction, the removable means includes means positioned inside the end of the bellows 68 for connecting the end of the bellows 68 to the pivot housing 30. Preferably, the end of the bellows 68 extends inside the opening 70 in the pivot housing 30 (see FIG. 2), and the connecting means includes biasing means positioned inside the end of the bellows 68 for biasing the bellows 68 outwardly against the pivot housing 30. In the preferred embodiment, the biasing means includes a spring clamp 72 (see FIGS. 2 and 3) received in the groove 74 to prevent the spring clamp 72 from slipping out of the end of the bellows 68.

As already described, the lip 76 has a radially inner surface defining the opening 70 and a rearward surface, and the flange 78 engages the rearward surface of the lip 76. Also, the groove 74 is located inwardly of the flange 78, or rearwardly of the rearward surface of the lip 76, and extends outwardly of the radially inner surface of the lip 76 into the flange 78 and beyond the inner surface of the lip 76. With this construction, the spring clamp 72 rigidifies the flange 78 and provides an interferance fit between the flange 78 and the lip 76.

The marine propulsion device 10 is assembled as follows. The forward end of the bellows 68 is secured to the gimbal housing 18 (by the band clamp 69) before the pivot housing 30 is connected to the gimbal housing 18 via the gimbal ring 20. Once the gimbal ring 20 and pivot housing 30 are connected to the gimbal housing 18, the rearward end of the bellows 68 is moved inside the opening 70 in the pivot housing 30 such that the flange 78 on the end of the bellows 68 engages the lip 76 on the pivot housing 30. Finally, the spring clamp 72 is inserted into the groove 74 so as to bias the bellows 68 outwardly against the pivot housing 30. The combined effect of the spring clamp 72 and the engagement of the lip 76 by the flange 78 is to substantially prevent both longitudinal and radial movement of the end of the bellows 68.

The propulsion unit 34 can be connected to and disconnected from the pivot housing 30 without affecting the connection of the rearward end of the bellows 68 to the pivot housing 30. When the propulsion unit 34 is disconnected from the pivot housing 30, the spring clamp 72 can be removed so as to allow disconnection of the rearward end of the bellows 68 from the pivot housing 30.

Various other features and advantages of the invention are set forth in the following claims.

I claim:

1. A marine propulsion device comprising a flexible conduit adapted to be supported from and extend rearwardly from the transom of a boat and comprising an end including an outwardly extending flange having a forwardly facing surface and an inside surface having therein an annular groove extending radially outwardly into said flange and including a radially outer part, a pivot housing adapted to be mounted on the transom of a boat for pivotal movement relative to the transom and comprising a passageway including a first passageway portion which is defined by a first interior surface portion having a circumference, and which receives said flange, said passageway also including an opening which is smaller than said first passageway portion, which is located immediately forwardly of said first passsageway portion and communicates therewith, and which is defined by a lip extending forwardly from said first interior surface portion and radially inwardly from said circumference of said first passage portion and beyond said radially outer part of said groove, and in engagement with said forwardly facing surface of said flange, and said passageway further including a second passageway portion which is at least as large as said first passageway portion, which is located immediately rearwardly of said first passageway portion and communicates therewith, and which is defined by an interior surface portion located immediately rearwardly of said first interior surface portion, and a spring clamp received in said groove for biasing said conduit outwardly against said pivot housing.

* * * * *